US006056377A

United States Patent [19]

Jeter

[11] Patent Number: 6,056,377

[45] Date of Patent: May 2, 2000

[54] DUAL-SLANT FILE HOLDER

[75] Inventor: Jack W. Jeter, Akron, Ohio

[73] Assignee: Jeter Systems Corporation, Akron, Ohio

[21] Appl. No.: 08/405,366

[22] Filed: Mar. 16, 1995

[51] Int. Cl.[7] ..... A47B 63/00

[52] U.S. Cl. ..... 312/183; 312/234.1; 312/35; 211/10

[58] Field of Search ..... 312/183, 234, 312/35, 234.1, 107, 9.53, 9.55, 9.56, 333; 211/41, 45, 128, 126, 40, 10, 11, 134

[56] References Cited

U.S. PATENT DOCUMENTS

| | | | |
|---|---|---|---|
| 3,269,788 | 8/1966 | Kneer | 211/10 X |
| 3,737,046 | 6/1973 | Jeter | 211/10 |
| 4,331,335 | 5/1982 | Starkweather | 312/35 X |
| 5,197,764 | 3/1993 | Hicinbothem et al. . | |
| 5,399,005 | 3/1995 | Schafer | 312/107 |

FOREIGN PATENT DOCUMENTS

| | | | |
|---|---|---|---|
| 629878 | 9/1949 | United Kingdom . | |
| 793646 | 4/1958 | United Kingdom | 211/11 |

*Primary Examiner*—Peter M. Cuomo
*Assistant Examiner*—Hanh V. Tran
*Attorney, Agent, or Firm*—Renner, Kenner, Greive, Bobak, Taylor & Weber

[57] ABSTRACT

A dual-slant file holder for angularly directing file folders in two directions. The dual-slant file holder has a front face, a base for carrying a slanted support surface and a pair of parallel side panels, wherein the angle between the slanted support surface and the base is between 5° and 40°, and wherein the angle between the pair of parallel side panels and the front face is between 5° and 40°. By holding a file folder within the dual-slant file holder any marking indicia disposed on the file folder is easily visualized by a clerk and can be easily removed and reinserted.

16 Claims, 1 Drawing Sheet

DUAL-SLANT FILE HOLDER

TECHNICAL FIELD

The invention resides generally in the art of shelving for holding file folders. Specifically, the present invention relates to a dual-slant file holder to provide quick visual recognition of indicia on the file folder and facilitate the insertion and extraction of file folders.

BACKGROUND ART

To assist in the organization and efficient operation of offices, it is known to put file folders in filing cabinets with drawers. Typically, drawer-type filing cabinets contain file folders that are organized by subject, client names, pre-assigned file numbers or any other such means. It is also known to write or mark on the file folder an appropriate indicia of the subject or client name associated with the file folder. The most common use of a filing cabinet is to have the file folders facing the front when the drawer is opened. If floor space is minimal within an office, it is also known to have filing cabinets with drawers containing the file folders in a side facing arrangement. Although effective in storing file folders, the drawer-type filing cabinets have several drawbacks. Primarily, it is time consuming to select the proper drawer, open it, choose the proper file folder and then close the drawer. It is also somewhat difficult to see the marking indicia on the file folders so that a desired file folder can be easily selected and withdrawn. Moreover, removing the file folder from the filing cabinet requires that adjacent files be moved out of the way so that the desired file folder can be grasped or reinserted.

To overcome some of the aforementioned drawbacks of drawer type filing cabinets, it is also known to store file folders on open-faced shelves so that the file folders are accessible from their side edges. It is well known that indicia such as tab markers can be affixed to the exposed vertical edges for organizational purposes. Although this side-facing arrangement saves space, it is still difficult to ascertain the marking indicia disposed on the file folder. Additionally, it is difficult to insert and extract the file folder from the shelf because adjacent files still must be moved out of the way.

One alternative to front facing or side facing filing systems is the use of a slant file as disclosed in U.S. Pat. No. 3,737,046. This patent discloses an open-shelf filing system which has parallel end faces and partitions extending from front to rear at an angle of between 40° and 60°. The primary advantage of employing this slant file is that the dimension of the shelving from front to back is greatly reduced. As such, the filing system can be placed along corridor walls without significantly narrowing the corridor width. Additionally, the staggered position of the file folders on the slant file exposes the marking indicia to view so that a particular file is identified more easily. Although an improvement over the drawer-type filing cabinets and open-shelf filing systems, the prior art slant file still evidences problems with inserting the desired file because neighboring file folders must first be moved out of the way. Although the slant file reduces the depth of the filing system, it correspondingly increases the length of the shelves and wall space required to implement the system.

Based upon the foregoing, it is evident that there is a need in the art for a dual-slant file holder that allows easy identification of marking indicia and also allows for easy insertion and extraction of the file folder by exposing the top corners of the file folders. Furthermore, there is also a need to provide a dual-slant file holder which has the appearance of a regular open-shelf filing system, and does not have the extreme dimensional space loss that is created by the current single slant file system. There is also a need to provide a dual-slant file holder which is configured such that the filing system is adapted for "fleeting" through the file folders as by sequential exposure of singular folders by deflecting said folders away from preceding folders by passing a thumb or finger across the outermost exposed edges of the folders.

DISCLOSURE OF INVENTION

In light of the foregoing, it is a first aspect of the present invention to provide a dual-slant file holder for supporting file folders.

Another aspect of the present invention is to provide a dual-slant file holder wherein the file folders have marking indicia disposed on their respective vertical edges which is easy to see.

Still a further aspect of the present invention is to provide a dual-slant file holder in which the file folders received therein are easy to insert and extract.

An additional aspect of the present invention is to provide a dual-slant file holder with a slanted support surface and a plurality of slanted support walls.

An additional aspect of the present invention is to provide a dual-slant file holder wherein the slanted supporting surface has a textured surface to increase its frictional coefficient so as to prevent file folders from slipping off of the surface.

Yet an additional aspect of the present invention is to provide a slanted support surface with a fabric strip disposed thereon so as to prevent file folders from slipping off of the surface.

The foregoing and other aspects of the invention which shall become apparent as the detailed description proceeds are achieved by a file holder, comprising: a front face; a slanted support surface; and a plurality of parallel support walls substantially perpendicular with the slanted support surface and slanted at an angle other than a right angle to the front face.

The present invention also provides a file holder, comprising: a front face; a base for carrying a slanted support surface and a plurality of parallel support walls substantially perpendicular to the slanted support surface, wherein the angle between the slanted support surface and the base is between 5° and 40°; and a cover carried by the plurality of parallel support walls and substantially parallel with the slanted support surface so as to form a plurality of file openings at the front face for receiving a plurality of file folders, wherein the angle between the plurality of parallel support walls and the front face is between 5° and 40°.

BEST MODE FOR CARRYING OUT THE INVENTION

Figure 1:
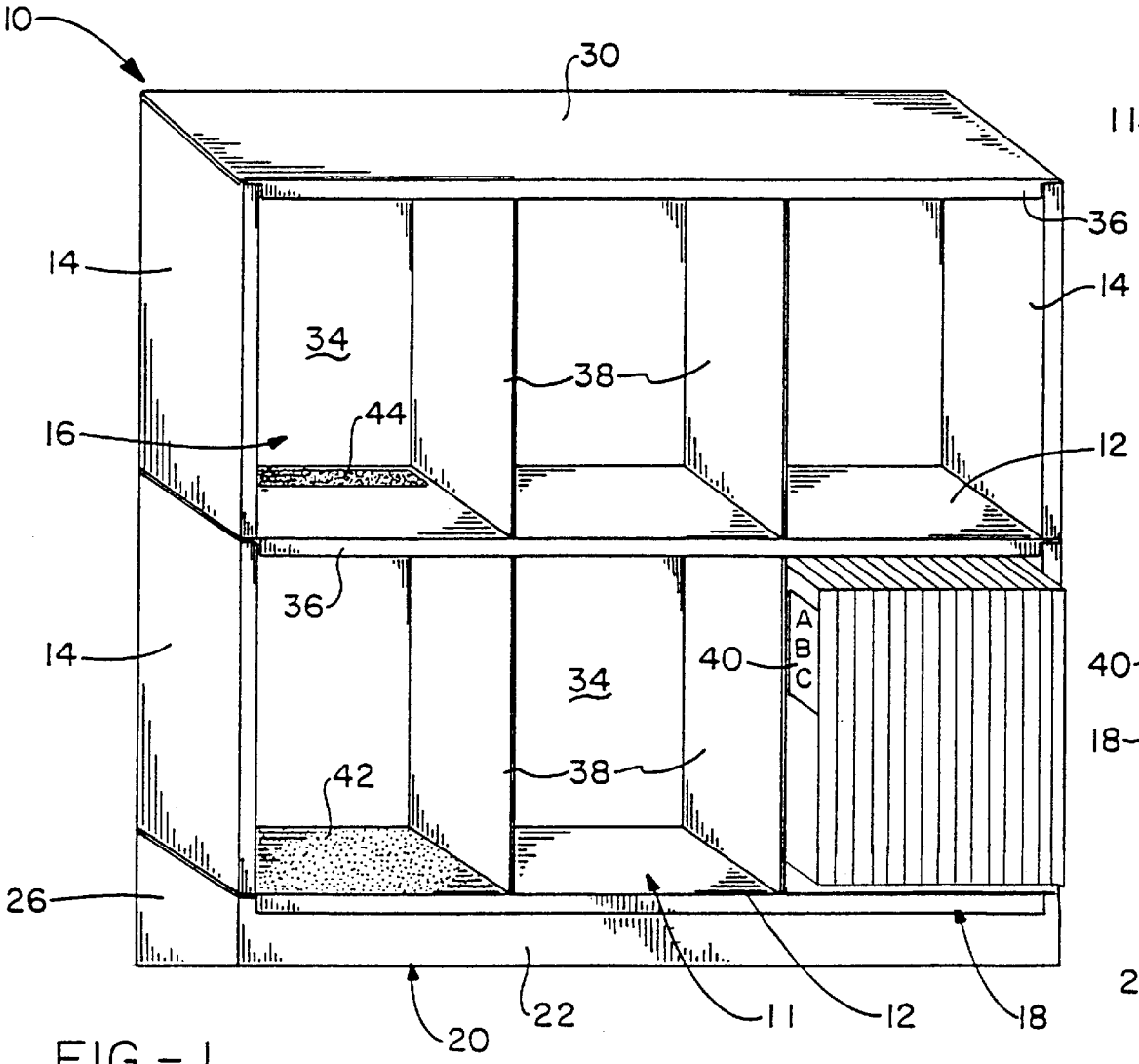
FIG. 1 is a front elevational view of a dual-slant file holder according to the present invention.

Referring now to the drawings and more particularly to FIG. 1, it can be seen that a dual-slant file holder according to the present invention is designated by the numeral 10. Generally, the dual-slant file holder 10 includes an open front face 11, slanted support surfaces 12, and a pair of slanted parallel support walls or side panels 14 which are perpendicular to the slanted support surfaces 12. As will be described in further detail below, the slanted support surfaces 12 and the side panels 14 form a file opening 16 for receiving a plurality of file folders 18 in such a manner that they are easy to locate, extract and insert. It will be appreciated that the dual-slant file holder 10 may be constructed so that there is a single file opening 16 or it may be partitioned or compartmentalized as shown. Moreover, the dual-slant file holder 10 can be of modular construction such that several file holders can be secured together in either a stacked or in side by side relation as desired.

Figure 2:
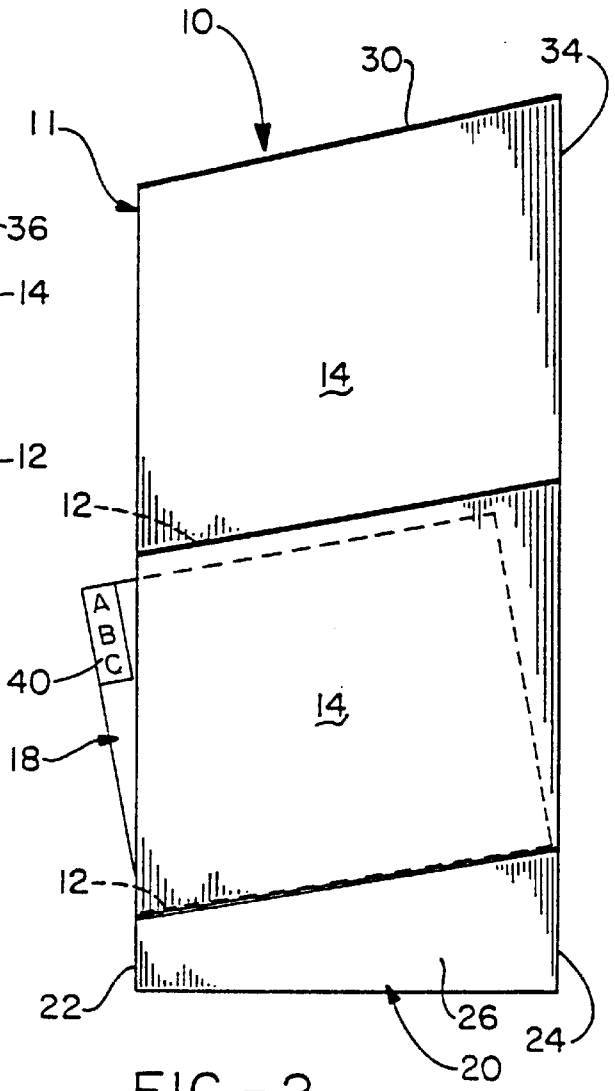
FIG. 2 is right side elevational view of the dual-slant file holder according to the present invention.

In particular, the dual-slant file holder 10 shown in FIGS. 1 and 2 has an open front 11 which is exposed to the person using the device. The lower one of the slanted support surfaces 12, which in the preferred embodiment are shaped in the form of an oblique parallelogram, is carried and supported by a base 20 such that the lower slanted support surface 12 is directed at an angle other than a right angle to the base 20. The base 20 is horizontally supported on a flat plane such as an office floor, bookshelf or other level surface. The base 20 includes a front wall 22 which is parallel with the front face 11, a back wall 24 which is parallel with the front wall 22, and a pair of sidewalls 26 which are trapezoidal in shape. Those skilled in the art will appreciate that the slant of the lower support surface 12 is established by the front wall 22 and the back wall 24 being of unequal heights. In other words, the front wall 22 is of a shorter height than the back wall 24 so that the lower support surface 12 is tilted at an angle other than a right angle to the plane on which the base 20 is supported. In the preferred embodiment the lower slanted support surface 12 is directed downwardly from the back wall 24 to the front wall 22. It is within the scope of this invention that the slanted support surface 12 could be directed downwardly from the front wall 22 to the back wall 24.

The parallel side panels 14 are substantially perpendicular to the slanted support surface 12 and are also in the shape of an oblique parallelogram. Moreover, the side panels 14 are directed at an angle other than a right angle with respect to the front face 11. In the preferred embodiment, the side panels 14 are angularly directed when considered from the front to the back of the file holder 10. However, it is also within the scope of the present invention that the side panels 14 could be directed to the right with respect to the front face 11.

A cover or top 30 encloses and is carried by the plurality of side panels 14. As will be appreciated by those skilled in the art, the cover 30 is in a parallel plane with respect to the slanted support surfaces 12 so as to form the file openings 16 for receiving a plurality of file folders 18.

The dual-slant file holder 10 also has a back wall 34, which is parallel with the back wall 24 of the base 20 and in interconnection with the side panels 14 and the cover 30. A lip 36 may be defined on a front edge of the upper slanted support surfaces 12, as shown. A plurality of slanted dividers 38 are in planes parallel to the parallel side panels 14 and are disposed therebetween to provide structural support to the dual-slant file holder 10. It will be appreciated by those skilled in the art that the vertical slanted divide 38 are substantially perpendicular to the slanted support surfaces 12. Moreover, the slanted dividers 38 may be constructed in such a manner that they are insertable anywhere along the length of the slanted support surface 12 so as to hold the file folders 18 in any manner desired. The dividers 38 may also be extended fully between the upper and lower support surfaces 12, or the upper support surface 12 and the top 30 to provide structural support and integrity.

The file folders 18 have indicia 40 disposed on a vertical edge so that a particular file folder 18 is easily identifiable and can be retrieved and inserted into the proper location within the dual-slant file holder 10.

The slanted support surfaces 12 may also have modifications made thereto so that the file folders 18 do not easily slip or fall from their location within the dual-slant file holder 10. In particular, the slanted support surfaces 12 may have a textured surface 42 which increases the frictional coefficient thereof to prevent the plurality of file folders from slipping on such slanted support surfaces. Another method of retaining the file folders 18 within the dual-slant file holder is to dispose a gripper surface 44, such as a piece of cloth or a portion of hook-and-loop material, on the slanted support surface 12 so as to prevent the file folders 18 from slipping.

In actual use, it can be seen that the dual-slant file holder 10 angularly directs the file folders 18 within the file opening 16 in two directions. First, the file folders 18 are directed inwardly and upwardly with respect to the base 20 on the slanted support surface 12. Secondly, the file folders 18 are angularly directed inwardly and toward the left with respect to the front face 11 by the side panels 14. It will be appreciated that the support surfaces 12 are carried or supported by the base 20, side panels 14 and partitions 38 such that the angle between the floor or other horizontal support surface and the slanted support surfaces 12 is between 5° and 40°. In the preferred embodiment, the angle between the floor and the slanted support surface 12 is 10°. In a similar manner, the angle between the parallel side panels 14 and the plane of the front face 11 is between 5° and 40° and in the preferred embodiment is 10°.

It will be appreciated then that the dual-slant file holder 10, which has a 10° slant rearwardly and upwardly and a 10° slant rearwardly and to the left, at first glance has the appearance of a regular open-face file holder. However, by slanting the support surfaces 12 and the side panels 14 several, distinct advantages are obtained over the normal open-face file holder.

As best seen in FIG. 2, the upper portion of the vertical edge of the file folder 18 extends outwardly from the front face 11. This allows a person facing the dual-slant file holder 10 to easily ascertain and see the marking indicia 40. In other words, the downward slant of the stored file folder 18 exposes the marking indicia 40 to more light than would a normal open-face file holder, and the directional slant to either the left or right exposes the marking indicia 40 to a broader spectrum of view for ease of readability. This is especially true when the marking indicia 40 is color coded in an easily recognizable fashion.

A further advantage of directing the file folders 18 in two directions is that the clerk fling the file folder 18 can take his or her thumb and/or fingers and "fleet" through the indicia markers 40 to easily see the indicia disposed thereon. In other words the clerk places his or her thumb on the edge of the file folder 18 and pushes it away to expose the marking indicia 40 until the file folder 18 deflects past the thumb and returns to its original position and the clerk's thumb rests on the adjacent file folder 18. As such, the clerk can quickly ascertain the location of the desired file folder 18. Another advantage of the dual-slant file holder 10 is in reinsertion of the file folders 18 into the file openings 16. Reinserting a file folder 18 within the file opening 16 requires only one hand to move the stored file folders 18 aside by directing the file folder 18 in a simultaneously downwardly and inwardly direction. This is in contrast to a normal vertical filing shelf which requires a strictly inward motion of the file folder such that is may be impeded by adjacent file folders. Thus, it will be appreciated by those skilled in the art that the dual-slant file folder 10, which directs the top corner of the file folders 18 to extend outwardly and downwardly from the front face 11, allows the "knifing" or reinsertion of the file folders 18 back into their proper position. A further advantage of the present invention is that the slanted support surfaces 12 and the slanted dividers 38 provide structural support to the dual-slant file holder 10 while classifying the file folders 18 as desired.

The dual-slant file holder 10 also provides two alternative embodiments. The first alternative embodiment provides for the textured surface 42 disposed on the slanted support surfaces 12. The textured surface 42 provides an increased frictional coefficient between the file folders 18 and the slanted support surfaces 12. As such, the file folders 18 are precluded from inadvertently slipping out of the file openings 16 and spilling onto the floor which supports the base 20. In a second alternative embodiment, a gripper surface 44 is secured to the slanted support surface 12. In a manner similar to the textured surface 42, the gripper surface 44 greatly increases the frictional coefficient between the file folders 18 and the slanted support surface 12. It will be appreciated by those skilled in the art that the gripper surface 44 could be a cloth-like material hook and loop fabric, or any other material on which a file folder does not easily move. It will also be appreciated that the gripper surface 44 may be selectively disposed on the slanted support surface 12 to achieve the desired combination of securing the file folder 18 within the dual-slant file holder 10 and for easily sliding the file folder into and out of the file opening 16.

Thus, it can be seen that the objects of the invention have been satisfied by the structure presented above. It should be apparent to those skilled in the art that the objects of the invention could be practiced with any size file folder 18 and that the dual-slant file holder 10 could be constructed in a modular fashion so that multiple file holders could be stacked upon one another or in adjoining side-by-side relation.

While the preferred embodiment of the invention has been presented and described in detail it will be understood that the invention is not limited thereto or thereby. As such, various angles may be used in the construction of the invention to meet the various needs of the end user. Accordingly, for an appreciation of the true scope and breadth of the invention, reference should be made to the following claims.

What is claimed is:

1. A file holder for holding a plurality of file folders, comprising:

a front face;

a first slanted support surface; and a plurality of parallel side panels substantially perpendicular to said first slanted support surface and slanted at an angle other than a right angle to said front face, said plurality of side panels and said first slanted support surface forming a file opening for receiving a plurality of file folders having a plurality of indicia thereon that extends beyond said front face.

2. The file holder, according to claim 1, further comprising a base for carrying said first slanted support surface, wherein said slanted support surface and said parallel side panels are oblique parallelograms.

3. The file holder, according to claim 2, further comprising a cover on said plurality of side panels to enclose said file opening.

4. The file holder, according to claim 3, further comprising:

a second slanted support surface parallel with said first slanted support surface and said cover and disposed therebetween; and a plurality of dividers substantially perpendicular to said first and second slanted support surfaces.

5. The file holder, according to claim 4, wherein said slanted support surfaces have a textured surface to increase the frictional coefficient thereof to prevent said plurality of file folders from slipping off said slanted support surface.

6. The file holder, according to claim 4, wherein said slanted support surfaces have a gripper secured thereto, so as to prevent said plurality of file folders from slipping off said slanted support surface.

7. A file holder for holding a plurality of file folders, comprising:

a front face;

a first slanted support surface in the shape of an oblique parallelogram; and a pair of parallel side walls in the shape of oblique parallelograms substantially perpendicular with said first slanted support surface and slanted at an angle other than a right angle to said front face, said pair of side walls and said first slanted support surface forming a file opening for receiving a plurality of file folders having a plurality of indicia thereon that extends beyond said front face.

8. The file holder, according to claim 7, further comprising:

a base for carrying said first slanted support surface wherein the angle between said base and said first slanted support surface is between 5° and 40°.

9. The file holder, according to claim 8 wherein the angle between said pair of side walls and said front face is between 5° and 40°.

10. The file holder, according to claim 9, further comprising a cover secured to said pair of side walls to enclose said file opening.

11. The file holder, according to claim 10 further comprising:

a second slanted support surface parallel with said first slanted support surface and said cover and disposed therebetween; and a plurality of dividers substantially perpendicular with said slanted support surfaces.

12. The file holder, according to claim 11, wherein said slanted support surfaces have a textured surface to increase the frictional coefficient thereof to prevent said plurality of file folders from slipping off said slanted support surfaces.

13. The file holder, according to claim 11, wherein said slanted support surfaces have a gripper secured thereto, so as to prevent said plurality of file folders from slipping off said slanted support surfaces.

14. A file holder for holding a plurality of non-magnetic file folders, comprising:

a front face;

a base for carrying a slanted support surface and a pair of parallel side walls substantially perpendicular to said slanted support surface, wherein the angle between said slanted support surface and said base is between 5° and 40°; and a cover carried by said pair of parallel side walls and substantially parallel with said slanted support surface so as to form a plurality of file openings at said front face for receiving a plurality of file folders wherein the angle between said pair of parallel side walls and said front face is between 5° and 40°, each of said plurality of non-magnetic file folders having a plurality of indicia thereon that extends beyond said front face.

15. The file holder, according to claim 14, wherein said slanted support surface has a textured surface to increase the frictional coefficient thereof to prevent said plurality of non-magnetic file folders from slipping off said slanted support surface.

16. The file holder, according to claim 14, wherein said slanted support surface has a gripper secured thereto, so as to prevent said plurality of non-magnetic file folders from slipping off said slanted support surface.

* * * * *